US005730589A

United States Patent [19]

Rausch et al.

[11] Patent Number: 5,730,589

[45] Date of Patent: Mar. 24, 1998

[54] HYDRAULIC DISPLACEMENT MACHINE HAVING GEARS PRESSED TOWARD EACH OTHER

[75] Inventors: Fred Rausch, Köditz; Horst Weidhaas, Hof, both of Germany

[73] Assignee: John S. Barnes GmbH, Hof, Germany

[21] Appl. No.: 673,529

[22] Filed: Jul. 1, 1996

[30] Foreign Application Priority Data

Apr. 15, 1996 [EP] European Pat. Off. ..... 96105855

[51] Int. Cl.[6] ..... F01C 1/18

[52] U.S. Cl. ..... 418/74; 418/78

[58] Field of Search ..... 418/71, 74, 78, 418/206.1

[56] References Cited

U.S. PATENT DOCUMENTS

| | | | |
|---|---|---|---|
| 2,624,287 | 1/1953 | Ilyin | 418/78 |
| 2,864,315 | 12/1958 | Udale | 418/78 |
| 3,285,188 | 11/1966 | Kita | 418/71 |
| 4,087,216 | 5/1978 | Shumate | 418/74 |
| 4,239,468 | 12/1980 | Smith | 418/78 |

FOREIGN PATENT DOCUMENTS

| | | | |
|---|---|---|---|
| 0018216 | 4/1980 | European Pat. Off. . | |
| 0029356 | 11/1980 | European Pat. Off. . | |
| 2264199 | 3/1975 | France . | |
| 438239 | 8/1948 | Italy | 418/79 |
| 907302 | 2/1982 | U.S.S.R. | 418/78 |
| 0541961 | 3/1940 | United Kingdom . | |
| 0965470 | 10/1961 | United Kingdom . | |

*Primary Examiner*—John J. Vrablik

*Attorney, Agent, or Firm*—Anderson, Kill & Olick, P.C.

[57] ABSTRACT

A hydraulic displacement machine including two external gears located in the machine housing and meshing with each other, with the teeth of the two gears sealingly engaging the inner surface of the housing, and with meshing teeth of the two gears sealing the two port regions from each other, and an arrangement for communicating pressure prevailing in the port region of the housing having a higher pressure to the port region of the housing having a lower pressure over a circumference of each of the two gears.

8 Claims, 1 Drawing Sheet

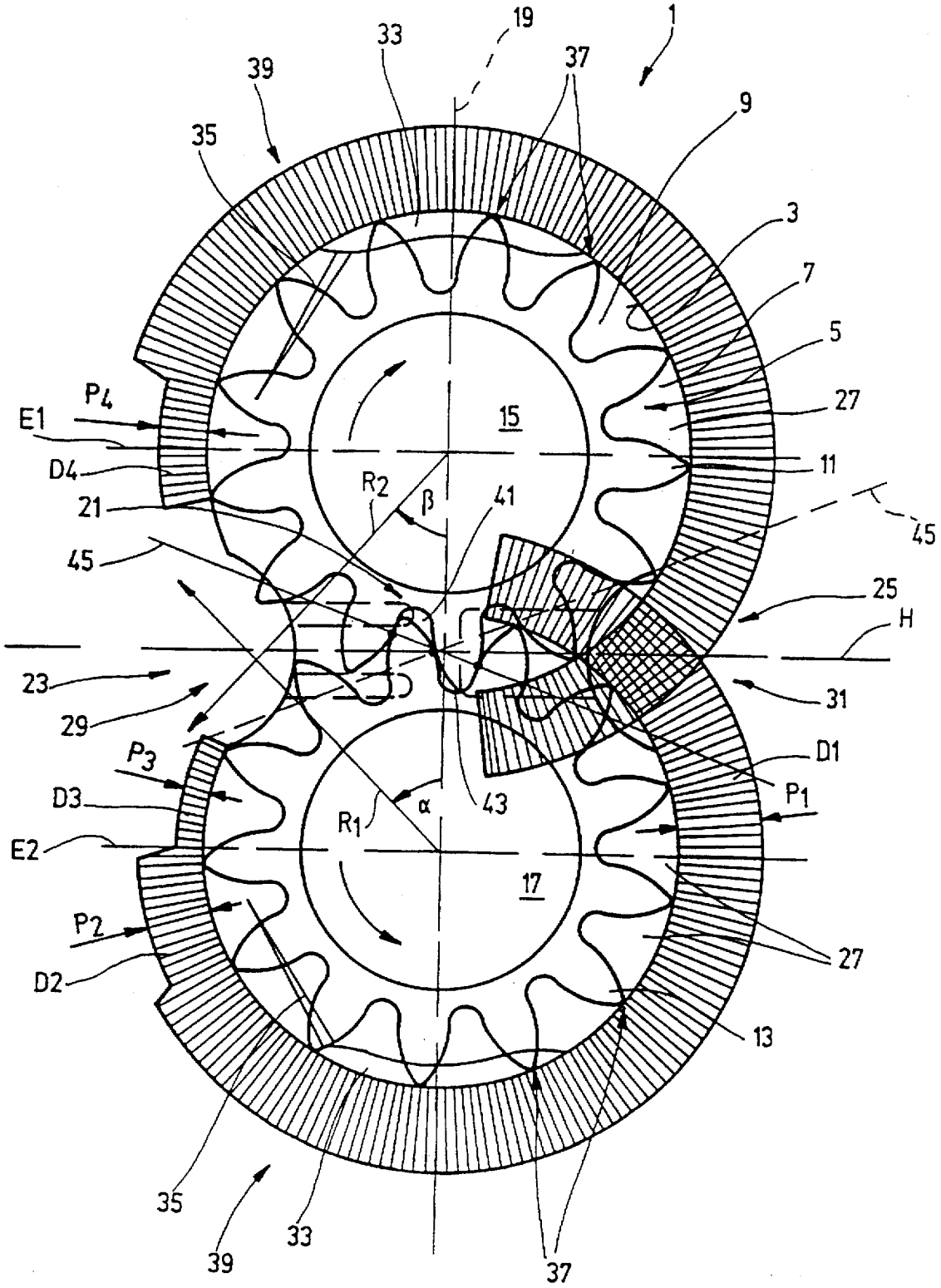
Fig.

HYDRAULIC DISPLACEMENT MACHINE HAVING GEARS PRESSED TOWARD EACH OTHER

BACKGROUND OF THE INVENTION

The present invention relates to a hydraulic positive displacement machine (further displacement machine) which includes a housing having an inner surface and two spaced port regions having different pressure levels, and two external gears located in the housing and meshing with each other with the teeth of the gears sealingly engaging the inner surface of the housing and sealing the two port regions from each other.

The displacement machines of this type are well known. These displacement machine are characterized by a large flow noise and relatively strong pulsation of the feed flow, both of which are highly undesirable. Further, because of the manufacturing tolerances (of the gear crowns and the inner diameter of the housing), a gap is formed between the gear crowns and the inner surface of the housing. Because of this gap, the system pressure prevailing in the pressure region partially acts on the gears generating a radial force tending to radially displace the gears. Another force acting on the gear is generated by a drive torque. At that, the action lines of the resultant forces acting on the two gears diverge from each other, i.e., the two resultant forces act in directions which cause the disengagement of the two gears. The disengagement of two gears leads to an increased flank clearance in the region in which the teeth of the two gears mesh with each other and which separates the two port regions, the pressure and suction regions. The increased flank clearance leads to a formation of a relatively large space volume between the teeth of the two gears. The large space volume results in that the hydraulic feed flow is subjected to pulsating pressure surges which, in turn, leads to an increased noise level.

Accordingly, an object to the invention is a displacement machine having reduced pulsations of the feed flow and, thereby, a reduced noise level.

SUMMARY OF THE INVENTION

This and other objects of the invention, which will become apparent further below, are achieved by providing means for communicating pressure prevailing in a port region having a higher pressure to a port region having a lower pressure over a circumference of each of the two gears whereby hydraulic forces, generated by communication of the pressure from the higher pressure port region, to the lower pressure port region bias or press the two gears toward each other. The forced engagement of the two gears insures, by simple means, that the resultant forces acting on the two gears intersect each other in the suction region of the machine. The intersection of the resultant forces in the suction region, the lower pressure port region insures that the two gears are biased toward each other in the region where their teeth mesh with each other. This reduces both the flank clearance and the available space volume between the meshing teeth of the two gears. The reduction in the space volume results in the reduction of the amount of fluid occupying this volume and, thereby, to the reduction of the feed flow pulsation. Thus, compression vibrations in the higher pressure port region and the resulting noise level of the displacement machine are substantially reduced.

According to a preferred embodiment of the present invention, the two port regions are separated by a double flank sealing which is achieved by providing resultant forces that so act on the two gears that they so move toward each other that the meshing teeth of the two gears form three sealing points, providing for reliable separation of the suction and pressure regions. The double flank sealing, three sealing points, result from the engagement of two flanks of a tooth of one gear with the flanks of the two adjacent teeth of the other gear. The three sealing points lie on the contact line of the two gears and move there along. The double flank sealing results in the reduction of the space volume between the meshing teeth which reduces the pulsation of the feed flow in comparison with the pulsation occurring when a single flank sealing is used. Providing a double flank sealing, three sealing points, in the separation region between the suction and pressure sides permits to reduce pulsation by about 75%. Because the noise level is directly proportional to the pulsation, the noise level is correspondingly reduced.

In yet another preferred embodiment of the invention, the resultant force forms, with the symmetry axis, and angle less then 90°. This is achieved by so selecting the manufacturing tolerances that they provide a clearance such that when the two gear move toward each other, both flanks of one gear engage the flanks of adjacent teeth of the other gear.

BRIEF DESCRIPTION OF THE DRAWINGS

The features and objects of the present invention will become more apparent, and the invention itself with be best understood from the following detailed description of the preferred embodiments when read with reference to the accompanying drawings, wherein:

Single FIGURE shows a cross-sectional view of a displacement machine according to the present invention.

DETAILED DESCRIPTION OF THE PREFERRED EMBODIMENTS

The following detailed description of the construction and operation of a displacement machine according to the present invention will be made with reference to a displacement pump, taken as an example of an inventive displacement machine. The displacement pump, which embodies, by way of example, a displacement machine according to the present invention, is formed as a gear pump which, in response to the application of a drive torque thereto, supplies fluid. Of course, the operation of such gear machine is reversible and it can operate as a motor. In this case, a fluid flow courses rotation of the gear set, so that a rotational torque applied to the gear set is transmitted with appropriate means to the rotational axle of the gear machine which axle performs the function of the drive shaft. The rotational torque is further transmitted by the drive axle to a consumer device.

The displacement machine or pump 1, shown in the figure, has a housing of which only the housing inner surface 3 is shown in the drawing. The inner surface 3 encloses an inner cavity 5 the end sides of which are limited by sealing surfaces. The sealing surfaces are closed with lids formed as pressure plates. In the drawing FIGURE, the front lid is removed, and only the rear lid 7 with its sealing surface 9 is shown. The cavity 5 has an eight-shaped cross-section and is formed by two bores having parallel axis. Two gears 11 and 13 having external teeth are arranged in the cavity 5. The gears 11 and 13 are fixedly supported on rotational axles 15 and 17, respectively, for joint rotation therewith. The side surfaces of the gears 11 and 13 sealingly abut the sealing surfaces. The gears 11 and 13 have each at least two teeth which sealingly engage the inner surface of the housing. The centers of the gears 11 and 13 lie in intersection points between a symmetry axis 19 and planes E1 and E2, respectively. The planes E1 and E2 extend parallel to each other and perpendicular to the symmetry axis 19. The gears 11 and 13 mesh with each other in a separation region 21 which separate two port regions 23 and 25 from each other. The to-be-fed fluid flows from the low pressure port region 23 (suction side) to the port region 25 (pressure side) which has a pressure exceeding that in the port region 23.

Feed pockets 27 are formed between two respective teeth of each gear and the housing inner surface 3. The pockets displace fluid from the suction side to the pressure side. A bore 29 is formed in the housing of the displacement machine 1 in the port region 23. The bore 29 is connected with a fluid conduit (not shown) for delivering fluid into the pump. A further bore 31 is provided in the port region 25 of the housing through which bore 31 fluid, which is displaced by the feed pockets 27, is fed under pressure to, e.g., a consumer device. Pressure distribution areas 33 and 35 are provided in the sealing surface 9 of the end lid 7. The function of the pressure distribution areas 33 and 35 will be discussed in detail further below. Because of the symmetry of the displacement machine 1 relative to a horizontal line H, only the function of the chambers 33 and 35, associated with the upper gear 11, will be discussed.

A predetermined clearance between the tooth crowns 37 of gears 11 and 13 and the housing inner surface 3 leads to the increase of pressure over the circumferential region of the gears from the high-pressure port region 25 in the direction toward the port region 23. The pressure acting along the circumference of the gears generates a radial force directed toward the gear center. This radial force is overridden by the mechanical force generated by the drive shaft. The radial and mechanical force by their vectorial addition, provide a resultant force the direction of action of which passes through the center of the respective gear. The resultant force below will be referred to simply as the resultant.

The resultant causes the displacement of gears, whereby some of tooth crowns 37 are pressed against housing inner surface 3 in the suction region, whereby the separation of the pressure region from the suction region is provided along the circumference of the gears 11 and 12. Due to their displacement, the gears 11 and 13 occupy an eccentric position in the housing of the displacement machine. In order to purposefully influence the direction of the resultant, the pressure distribution areas 33 and 35 are provided in respective regions of the sealing surface 9. The pressure, which prevails in the port region 25, increases over the gear circumferential region. This pressure is transmitted over the pressure distribution area 33 and over the circumferential region of the gear in the direction to the suction region. The pressure distribution area 33 starts, when viewed in the feeding direction, at least 90° from the bore 31 and extends circularly over an angle of about 70° over the gear circumference.

The groove-shaped pressure distribution area 33, in the embodiment shown, if formed symmetrically with respect to the symmetry axis 19. The groove-shaped pressure area 33 is formed in the sealing surface 9 of the lid 7. Alternatively, it is possible to transmit the pressure from the pressure region over a recess, groove, a return channel or the like formed in the inner surface 3 of the housing and serving as a pressure distribution area.

A groove-shaped channel, which is referred to as the pressure distribution area 35, extends from the pressure distribution area 33 in a direction toward the port region 23. The pressure distribution area 35 has a cross-section which narrows in the direction toward the port region 23. The pressure distribution area 35 transmits the system pressure back to an area lying about 45° in front of the bore 29 of the connection region 23. Instead of or in addition to the pressure distribution area 35, a pressure return channel, bore, groove or the like can be formed in the housing of the displacement machine 1, namely, in the housing inner surface 3. The location of the pressure distribution areas 33 and 35 in or on the displacement machine is generally arbitrary selected. The important thing is to so distribute the system pressure over the gear periphery that the gears are pressed against each other.

In the drawing, the instant pressure distribution on the circumference of the gears 11 and 13, which causes the displacement of gears into a position in which they are pressed against each other, is shown by hatched surface 39. According to the position of the gears 11 and 13, pressure fields having different pressures are formed along their periphery. Thus, the gear 13 has a first pressure field D1 extending from the pressure region in the direction toward the suction region over an angle of about 230°. The width of the pressure field D1, which is shown as a circular segment, corresponds to the maximal pressure prevailing in the port region 25 (system pressure). The pressure field D1 is connected with the second pressure field D2 which extends over an angular region of about 30°. The pressure p2 which prevails in the second pressure region D2 constitutes about 80% of the maximal pressure p1. The pressure field D2 is connected to a third pressure field D3 which extends up to the bore 29 of the port region 23. The pressure p3, which prevails in the third pressure region 23, constitutes about 10% of the maximal pressure p1. Providing, according to the invention, of the pressure distribution areas 33 and 35 permitted to precisely determine the extent of the pressure fields D1–D3 over the gear circumference and the pressures p1–p3 prevailing in the respective fields. The resulting radial forces, as it was discussed above, are overridden by the mechanical forces generated by the drive rotational torque. The resulting force of resultant R1 acts in the center of the gear 12 and forms with the symmetry axis 19 an angle smaller than 90°. A pressure field D1 extends along the circumference of the gear 11. The pressure of this pressure field D1 equals to the maximal pressure p1. This pressure field D1 extends over an angular region of 230°. The pressure field D1 of the gear 11 is connected to a pressure field D4 having a pressure p4 which constitutes about 60% of the maximal pressure p1. The pressure forces, which are generated by the pressure fields D1 and D4 form, together with the mechanical force, which is generated by the drive torque, a resultant R2 which forms with symmetry axis 19 an angle smaller than 90°.

Both resultants R1 and R2 are directed relative to each other at such an angle that they intersect each other in the area of the suction region of the displacement machine which is located leftward of the symmetry axis 19 between planes E1 and E2. Thereby, the gear 11 and 13 are pressed toward each other in the separation region 21 providing a double flank sealing. A double flank sealing, as it was explained previously, means that two flanks of a tooth of one gear abut adjacent teeth of the other gear and roll over the adjacent teeth. Thereby, three engagement points are provided between gears 11 and 13 in the separation region 21, and two cavities 41 and 43 are formed in which a certain volume is catched and practically constantly displaced in a circle. The engagement points always lie on the same contact line 45 and move there along. The double flank sealing permits to reduce the catch volume in the cavities 41 and 43 which substantially reduces the pulsation of the fluid flow.

The sealing of the suction region from the pressure region with the double flank sealing is a substantial improvement over the single flank sealing presently used in the conventional displacement machines and having only two contact of engagement points in the separation region. With the single flank sealing, the feed flow pulsation exceeds that obtained with a double flank sealing by a factor of four.

The position of the pressure distribution areas 33 and 35, their shape and longitudinal extent over the gear circumference varies in accordance with the displacement layout (number teeth, tooth geometry.) The important thing is to so distribute the pressure in the port region 25 over the gear circumference that the resultants R1 and R2 intersect each other in the suction region and form with the symmetry axis an angle smaller than 90°. In this way, an optimal sealing between the suction and pressure region is achieved which is suitable for all acting hydraulic forces. No additional mechanical elements are required for pressing the gears toward each other and which may be subjected to an excessive wear.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope the appended claims.

What is claimed is:

1. A hydraulic displacement machine, comprising:

a housing having an inner surface and two spaced port regions having different pressure levels;

two external gears located in the housing and meshing with each other, the gear having teeth thereof sealingly engaging the inner surface of the housing, and meshing teeth of the two gears sealing the two port regions from each other; and means for communicating pressure prevailing in a port region having a higher pressure to a port region having a lower pressure over a circumference of each of the two gears, whereby hydraulic forces, which are generated by communication of the pressure from the higher pressure port region to the low pressure port region, press the two meshing gear toward each other, wherein the pressure communicating means comprises a pressure distribution area for a predetermined distribution of the higher pressure over the gear circumference, and wherein the pressure distribution area includes an area portion having a tapering cross-section and extending in a region of the gear located at about 45° from the lower pressure port region.

2. A hydraulic displacement machine as set forth in claim 1, wherein the meshing teeth of the two gears form a double flank sealing.

3. A hydraulic displacement machine as set forth in claim 1, wherein at least two teeth of each of the two gears sealingly engage the inner surface of the housing.

4. A hydraulic displacement machine as set forth in claim 1, further comprising two axles located in the housing for supporting the two gears for rotation therewith, wherein a resultant force, which is obtained by vectorial addition of hydraulic radial forces acting on a respective one of the two gears and mechanical forces generated by application of a rotational torque to an axle of the respective one of the two gears, acts in a direction forming with an axis of symmetry of the machine an angle smaller than 90°.

5. A hydraulic displacement machine as set forth in claim 1, wherein the pressure distribution area is provided in a region located adjacent to the inner surface of the housing and opposite a meshing regional of the two gears.

6. A hydraulic displacement machine as set forth in claim 1, wherein the pressure distribution area extends over a region of the gear circumference of about 70° and is substantially symmetrical with respect to an axis of symmetry.

7. A hydraulic displacement machine as set forth in claim 1, further comprising a lid for side wise closing of the housing, the pressure distribution area comprising a groove formed in one of a sealing surface of the lid and the inner surface of the housing.

8. A hydraulic displacement machine as set forth in claim 7, wherein the groove is formed in the sealing surface of the lid.

* * * * *